US008342261B2

(12) United States Patent
Ahola et al.

(10) Patent No.: US 8,342,261 B2
(45) Date of Patent: Jan. 1, 2013

(54) METHOD AND EQUIPMENT FOR SMALL-CHARGE BLASTING

(75) Inventors: Erkki Ahola, Kangasala (FI); Veikko Räisänen, Nokia (FI)

(73) Assignee: Sandvik Mining & Construction Oy, Tampere (FI)

( * ) Notice: Subject to any disclaimer, the term of this patent is extended or adjusted under 35 U.S.C. 154(b) by 237 days.

(21) Appl. No.: 12/810,092

(22) PCT Filed: Dec. 17, 2008

(86) PCT No.: PCT/FI2008/050751

§ 371 (c)(1), (2), (4) Date: Jun. 22, 2010

(87) PCT Pub. No.: WO2009/083644

PCT Pub. Date: Jul. 9, 2009

(65) Prior Publication Data

US 2010/0270076 A1 Oct. 28, 2010

(30) Foreign Application Priority Data

Dec. 27, 2007 (FI) ..... 20075961

(51) Int. Cl.
*E21C 37/14* (2006.01)

(52) U.S. Cl. ..... 175/2; 299/13

(58) Field of Classification Search ..... 175/2; 299/13; 102/313

See application file for complete search history.

(56) References Cited

U.S. PATENT DOCUMENTS

| | | | | |
|---|---|---|---|---|
| 3,130,797 | A | 4/1964 | Johnson | |
| 3,721,471 | A * | 3/1973 | Bergmann et al. | 299/55 |
| 5,308,149 | A | 5/1994 | Watson et al. | |
| 5,803,551 | A | 9/1998 | McCarthy | |
| 6,339,992 | B1 * | 1/2002 | Watson | 102/312 |
| 6,347,837 | B1 | 2/2002 | Watson et al. | |
| 6,435,096 | B1 * | 8/2002 | Watson | 102/319 |
| 7,069,862 | B2 * | 7/2006 | Bassett | 102/319 |

FOREIGN PATENT DOCUMENTS

| | | |
|---|---|---|
| EP | 1 338 758 | 8/2003 |
| EP | 1 990 503 | 11/2008 |
| WO | 2006/099637 | 9/2006 |

OTHER PUBLICATIONS

Finnish Office Action dated Nov. 11, 2008.
Finnish Search Report dated Nov. 10, 2008.

* cited by examiner

*Primary Examiner* — William P Neuder
(74) *Attorney, Agent, or Firm* — Morgan, Lewis & Bockius LLP

(57) ABSTRACT

A method for small-charge blasting, and a rock drilling unit used therein. By means of a rock drilling machine of the rock drilling unit, a drill hole is first drilled into material to be excavated, after which one or more cartridges comprising a propellant charge are fed through a drilling tool onto the bottom of the drill hole. The drilling unit comprises a cartridge feed station, which is separate from the rock drilling machine and from which the cartridges may be fed into a longitudinal channel in the drilling tool.

6 Claims, 2 Drawing Sheets

METHOD AND EQUIPMENT FOR SMALL-CHARGE BLASTING

BACKGROUND OF THE INVENTION

The invention relates to a method for small-charge blasting, the method comprising drilling with a rock drilling machine a drill hole into a material to be excavated and feeding, after the drilling, at least one cartridge comprising a propellant charge to the drill hole by means of a drilling unit. After this, the drill hole is sealed before the cartridge is ignited. The ignition of a small charge applies a great gas pressure in the borehole, causing fracturing of the material to be excavated.

The invention further relates to a rock drilling unit for small-charge blasting. The drilling unit comprises a feed beam, a rock drilling machine and a drilling tool, which is connected to the rock drilling machine and comprises a channel for feeding a cartridge along the channel into a drill hole. The cartridge is fed to the channel in the drilling tool by means of a feed station.

The field of the invention is defined in greater detail in the preambles of the independent claims.

In small-charge blasting, a cartridge comprising a propellant charge or a similar small charge is arranged in a drill hole. When the cartridge is ignited, a great gas pressure is produced in the drill hole. A great pressure in the drill hole causes controlled cracking in the material to be excavated. Compared to conventional explosion blasting, small-charge blasting provides the advantage that the rock drilling rig need not be transferred away from the drilling site for ignition after the drilling, and thus blasting may be carried out continuously. Furthermore, small-charge blasting does not produce big stress waves, whereby the part of the rock that is not to be broken, stays intact and does not require support. Small-charge blasting is also safer and produces less dust.

U.S. Pat. No. 5,308,149 discloses a drilling unit comprising a rock drilling machine and a feed apparatus for cartridges, which may be indexed on a feed beam. First, a drill hole is drilled by the rock drilling machine, and then the cartridge feed apparatus is indexed at the drill hole for feeding cartridges into the drill hole. The cartridge feed apparatus comprises a massive stemming bar, by which the cartridge is pushed onto the bottom of the drill hole and by which bar the bottom of the drill hole is also sealed. WO 2006/099 637 discloses an alternative arrangement for small-charge blasting. It does not require a separate cartridge feed apparatus in addition to the rock drilling machine, but the cartridges are fed from a feed station in the rock drilling machine to a shank and further through the drill rods to a drill bit, from which they are led to the bottom of the drill hole. A drawback of this solution is that it requires the use of a custom-made rock drilling machine.

BRIEF DESCRIPTION OF THE INVENTION

It is an object of the present invention to provide a new and improved method and drilling unit for small-charge blasting.

The method of the invention is characterized by feeding the cartridge into a channel of a drilling tool from a cartridge feed station separate from the rock drilling machine.

The drilling unit of the invention is characterized in that the cartridge feed station is a unit separate from the rock drilling machine.

The idea of the invention is that the cartridge feed station is arranged separate from the rock drilling machine, which makes it an individual unit separate from the rock drilling machine.

The invention provides an advantage that a quite normal rock drilling machine may be used in the drilling, because the feed station is an independent separate unit. In this case, the critical component, i.e. the rock drilling machine, need not be constructed anew, but any available percussion rock drilling machine or rotary rock drilling machine may be used. In addition, the construction of the separate feed station may be selected freely according to the need. Furthermore, the feed station may be an easily replaceable component. All in all, the structure of the equipment is simpler, because the rock drilling machine and the feed station are separate units.

The idea of an embodiment is that a separate cartridge feed station is arranged on the front side of the rock drilling machine.

The idea of an embodiment is that the rock drilling machine and the cartridge feed station are arranged on the feed beam on the same carriage.

The idea of an embodiment is that the rock drilling machine is arranged on the feed beam on a first carriage and the cartridge feed station is arranged on the feed beam on a second carriage.

The idea of an embodiment is that the rock drilling machine is provided with an extended shank, which extends to the separate feed station arranged on the front side of the rock drilling machine. In addition, at least the part of the shank on the side of the drilling tool comprises a longitudinal channel. The extended shank further comprises at least one feed opening for feeding cartridges from the cartridge feed station to the channel of the shank and further to the channel of the drilling tool connected to the shank.

The idea of an embodiment is that the drilling tool arranged at the shank of the rock drilling machine comprises at least one feed opening at the cartridge feed station for feeding cartridges from the cartridge feed station to the channel of the drilling tool.

BRIEF DESCRIPTION OF THE FIGURES

Some embodiments of the invention are explained in greater detail in the attached drawings, in which FIG. 1 schematically shows a rock drilling rig, which is provided with drilling units of the invention for small-charge blasting, FIG. 2 schematically shows a top view of a situation where a cartridge and sealing medium are fed through a drilling tool into a drill hole, FIG. 3 schematically shows a side view of a rock drilling unit of the invention, wherein a cartridge is fed from a cartridge feed station situated on the front side of a rock drilling machine on its own carriage to an extended shank and further by means of pressurized water along a channel in the tool further to a drill hole, and FIG. 4 schematically shows a side view of a second rock drilling unit of the invention, wherein a cartridge is fed from a cartridge feed station, which is situated on the front side of a rock drilling machine and arranged on the same carriage, into a feed opening of the first drilling tool connected to the rock drilling machine and further by means of pressurized water along a channel in the drilling tool to a drill bit and further onto the bottom a drill hole.

For the sake of clarity, some embodiments of the invention are shown simplified in the figures. Like parts are denoted by the same reference numerals in the figures.

DETAILED DESCRIPTION OF SOME EMBODIMENTS OF THE INVENTION

Figure 1:
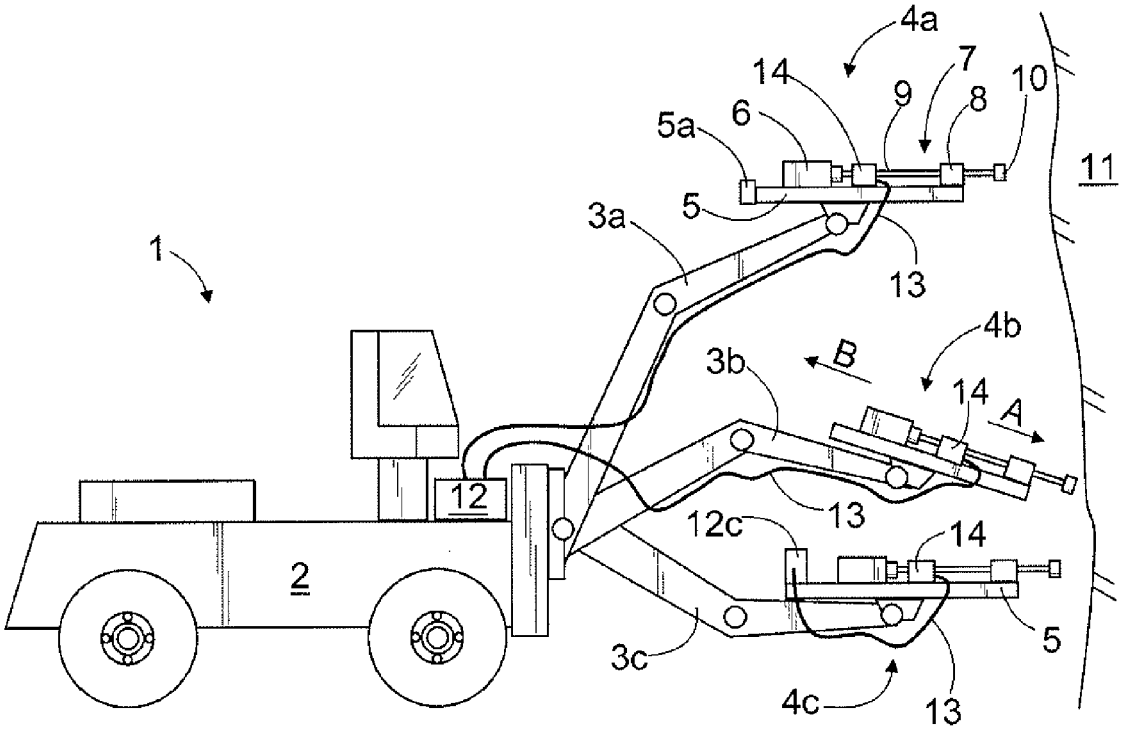
Figure 2:
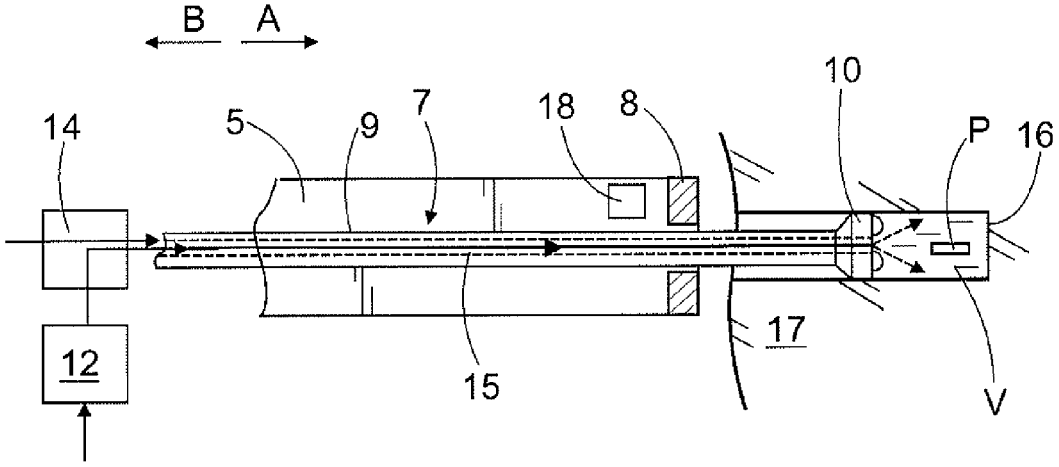

A rock drilling rig 1 shown in FIG. 1 comprises a moving carrier 2, three drilling booms 3*a* to 3*c*, and drilling units 4*a* to 4*c* on each drilling boom. The drilling unit 4 comprises at least a feed beam 5, a rock drilling machine 6, a feed apparatus 5*a* for moving the rock drilling machine 6 on the feed beam in the feed direction A and in the return direction B, and further a drilling tool 7 connected to the rock drilling machine 6 and, in the front part of the feed beam 5, a front guide 8, through which the drilling tool 7 is arranged. The drilling tool 7 may comprise one or more drill rods 9 and a drill bit 10 at the outermost end of the tool. Alternatively, the drilling tool 7 may be an integral rod, the outermost end of which is provided with bits or the like. The rock drilling machine 6 may be a percussion drilling machine comprising a percussion device with which impact pulses are given to the drilling tool and further transmitted by means of the tool to the rock or similar material 11 to be excavated. The percussion rock drilling machine may comprise a rotating device for turning the drilling tool about its longitudinal axis. Alternatively, it may deal with a non-percussive rock drilling machine, in which case the drilling is performed by the rotating motion only. It is not relevant to the central idea of the invention, which drilling technique is used for drilling a drill hole. Cartridges used in small-charge blasting may be fed from a cartridge magazine 12 on the carrier 2 along a feed channel 13 to a cartridge feed station 14 and further along a channel 15 in the drill rod 9 into a drill hole 16, as shown in FIG. 2. Alternatively, the cartridge magazine 12*c* may be located at the drilling unit 4.

FIG. 2 illustrates the principle of small-charge blasting. A drill hole 16 is drilled in the rock 17 conventionally by using the rock drilling machine 6 and the tool 7 connected thereto. After the drilling has been finished, the tool 7 may be pulled in the return direction B a distance away from the bottom of the drill hole 16. The tool is, however, held in the drill hole. After this, a cartridge P may be fed from the cartridge magazine 12 or the like to the feed station 14 on the feed beam 5, the feed station being in connection with the longitudinal channel 15 in the tool 7. The cartridge P may be fed by means of a pressure medium, such as pressurized water or air, or even a suitable pusher, such as a cable, may be used. After one or more cartridges P have been fed to a space between the drill bit 10 and the drill hole bottom, the drill hole bottom may be sealed by feeding water from the channel 15. Sealing water V fills in cracks in the drill hole, whereby the pressure caused by the cartridge P is maintained better in the drill hole and the rock breaks more easily. The sealing water V also serves as a medium transmitting the pressure effect produced by the cartridge P to the rock. The tool 7 may be held in the drill hole 16 for the time of ignition of the cartridge, whereby the tool 7 serves as stemming for the mouth of the drill hole and prevents the pressure produced by the cartridge P from escaping from the drill hole 16.

After the cartridge P has been fed and the drill hole 16 sealed, the cartridge P may be ignited by giving an ignition impulse by means of an ignition apparatus 18 or the like. The cartridge P may comprise a pressure-sensitive igniter, whereby it may be ignited by giving a pressure impulse to filler water V around the cartridge by means of the ignition apparatus 18. On the other hand, the ignition apparatus 18 may give a mechanical impulse via the drilling tool 7 to the cartridge P igniter, or the igniter may be ignited by means of electromagnetic waves or impulses. The ignition apparatus 18 may be arranged in the drilling unit 4. If electromagnetic waves are used for ignition, the ignition apparatus 18 may be outside the drilling unit and the ignition may be performed by remote control from the cabin of the rock drilling rig 1, for instance.

Figure 3:
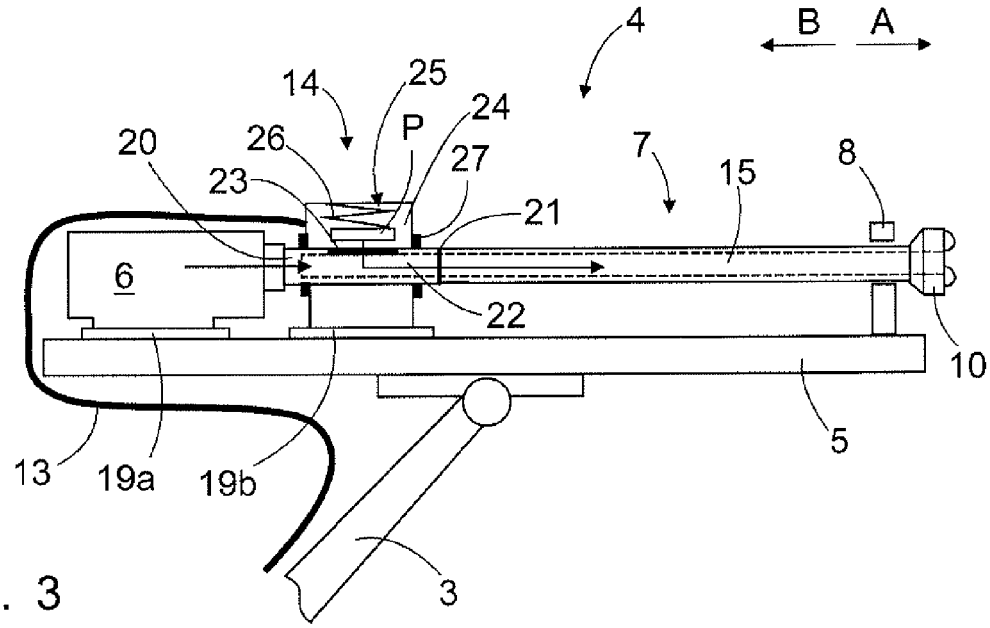

FIG. 3 shows a greatly simplified view of a drilling unit 4, in which, in the feed direction A, on the front side of the rock drilling machine 6 there is arranged a cartridge feed station 14, which is an independent physical unit separate from the rock drilling machine 6. The rock drilling machine 6 may be arranged movably on the feed beam 5 by means of a first carriage 19*a*, and the cartridge feed station 14, for its part, may be arranged movably on the feed beam 5 by means of a second carriage 19*b*. As a shank 20 for the rock drilling machine 6 with a basic structure, a shank that is longer than usual may be arranged, the shank extending to the feed station 14. In this case, a connection 21 between the tool 7 and the shank 20 is on the front side of the feed station 14. In the shank 20 there is at least at the feed station 14 an axial channel 22, which is in connection with the channel 15 in the tool 7. In addition, the shank 20 comprises at least one cross-direction feed opening 23, through which the channel 22 is in connection with a feed chamber 24 of the feed station 14 and further with the feed channel 13 in connection with the feed station 14. In this case, the cartridge P fed from the feed channel 13 may be transferred, controlled by feed means 25 in the feed chamber 24 of the feed station 14, through a feed opening 23 into the channel 22 of the shank 20 and further along the channel 15 of the tool 7 into the drill hole. The feeding means 25 may be an actuator operated by a spring element 26, a pressure medium or the like, transferring the cartridge P to the feed opening 23 in a direction transverse to the drilling line. The feed station 14 may further comprise sealing means 27, by which the shank 20 may be sealed in the feed station 14. In this way, the feeding of flush water supplied from the feed channel 13 and/or the rock drilling machine 6, water used in the feeding of cartridges P, sealing water V or a similar pressure medium is carried out in a controlled manner. The feed station 14 may naturally be constructed in a manner different from that shown in FIG. 3 by way of example.

Figure 4:
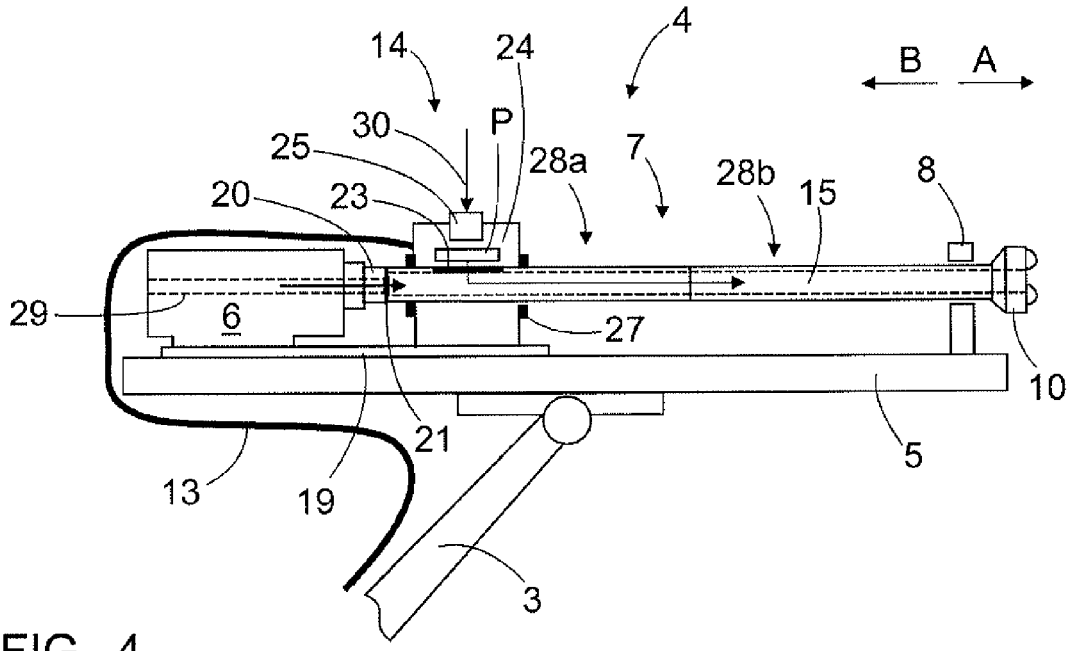

FIG. 4 shows a greatly simplified view of another rock drilling unit 4, which differs from that shown in FIG. 3 at least in that here the rock drilling machine 6 and the feed station 14 are arranged on the same carriage 19. Furthermore, a normal shank 20 is fixed to the rock drilling machine 6 and the tool 7 is fixed to the extension of the shank. At the section of the tool 7 end on the side of the rock drilling machine 6 there is at least one feed opening 23 extending from the outer surface of the tool 7 to the channel 15, whereby a cartridge P may be fed through it. The feed opening 23 is at the feed station 14. The tool 7 may comprise one or more drill rods 28*a*, 28*b*, of which the first drill rod 28*a* closest to the rock drilling machine 6 is provided with the feed opening 23.

FIG. 4 also shows by means of a broken line 29 a channel, which may extend through a percussion element of the rock drilling machine 6, and along which channel or along a pipe arranged through it water may be fed to the shank 20 in order to feed cartridges P to the drill hole. Instead of this pipe flushing, water may be fed into flushing channels in the shank 20 through the feed channel 13 or from a channel 30 in connection with the feed station 14. Driving force may also be supplied from the channel 30 to a feed means 25 operated by a pressure medium.

It is to be noted that the feed station 14 need not necessarily be located at a distance away from the rock drilling machine 6, as shown in FIGS. 3 and 4, but the feed station 14 may be arranged against the front part of the rock drilling machine 6. Yet another possibility is to arrange the feed station on the back side of the rock drilling machine, whereby the cartridges are fed along the channel 29 in accordance with FIG. 4 through the rock drilling machine to the shank and further along the channel in the tool into the drill hole.

In some cases, the features presented in this application may be used as such, in spite of other features. On the other hand, the features described in the present application may be combined to form different combinations, if necessary.

The drawings and the related description are only intended to illustrate the idea of the invention. In its details, the invention may vary within the scope of the claims.

The invention claimed is:

1. A method for small-charge blasting, the method comprising:

performing the blasting by a rock drilling unit comprising at least a feed beam, a feed apparatus, a rock drilling machine, and a drilling tool;

drilling a drill hole into material to be excavated with the rock drilling machine;

keeping the drilling tool in the drilled hole after the drilling;

feeding, after the drilling, at least one cartridge comprising a propellant charge into the drill hole along at least one channel in the drilling tool;

feeding the cartridge from a cartridge feed station into the channel of the drilling tool;

sealing the drill hole;

igniting the cartridge, wherein a gas pressure is produced in the drill hole, sufficient to cause cracking in the material to be excavated; and feeding the cartridge into the channel of the drilling tool from the cartridge feed station separate from and removably attached to the rock drilling machine.

2. A rock drilling unit for small-charge blasting, the drilling unit comprising:

a feed beam;

a rock drilling machine;

a feed apparatus, by which the rock drilling machine is movable on the feed beam in a feed direction and in a return direction;

a drilling tool, which is connected to the rock drilling machine and comprises at least one longitudinal channel; and a cartridge feed station, by which a cartridge comprising a propellant charge may be fed to the drilling tool and along a channel in the drilling tool into a drill hole, wherein the cartridge feed station is a unit separate from the rock drilling machine, and wherein the separate cartridge feed station is arranged on the feed beam on a front side of the rock drilling machine.

3. A drilling unit as claimed in claim 2, wherein the rock drilling machine and the cartridge feed station are arranged on the feed beam on a same carriage.

4. A drilling unit as claimed in claim 2, wherein:

the rock drilling machine is arranged on the feed beam on a first carriage; and the cartridge feed station is arranged on the feed beam on a second carriage.

5. A drilling unit as claimed in claim 2, wherein:

the rock drilling machine is provided with an extended shank, which extends to the separate feed station arranged on a front side of the rock drilling machine, at least the part of a shank on a side of the drilling tool comprising a longitudinal channel; and the extended shank comprises at least one feed opening for feeding cartridges from the cartridge feed station to the channel of the shank and further to the channel of the drilling tool connected to the shank.

6. A drilling unit as claimed in claim 2, wherein the drilling tool connected to a shank of the rock drilling machine comprises at least one feed opening at the cartridge feed station for feeding cartridges from the cartridge feed station to the channel of the drilling tool.

* * * * *